US005375579A

United States Patent [19]

Mukai

[11] Patent Number: 5,375,579

[45] Date of Patent: Dec. 27, 1994

[54] EVAPORATED FUEL CONTROLLER

[75] Inventor: Takeshi Mukai, Shizuoka, Japan

[73] Assignee: Suzuki Motor Corporation, Shizuoka, Japan

[21] Appl. No.: 124,337

[22] Filed: Sep. 20, 1993

[30] Foreign Application Priority Data

Feb. 26, 1993 [JP] Japan ..... 5-063033

[51] Int. Cl.[5] ..... F02M 33/02

[52] U.S. Cl. ..... 123/520; 123/516

[58] Field of Search ..... 123/520, 519, 518, 516, 123/521

[56] References Cited

U.S. PATENT DOCUMENTS

| | | | |
|---|---|---|---|
| 4,127,097 | 11/1978 | Takimoto | 123/520 |
| 4,527,532 | 7/1985 | Kasai | 123/520 |
| 5,060,621 | 10/1991 | Cook | 123/520 |
| 5,190,015 | 3/1993 | Nakata | 123/520 |
| 5,195,495 | 3/1993 | Kitamoto | 123/520 |
| 5,216,998 | 6/1993 | Hosoda | 123/520 |

FOREIGN PATENT DOCUMENTS 61-268861 11/1986 Japan .

*Primary Examiner*—Carl S. Miller

*Attorney, Agent, or Firm*—Flynn, Thiel, Boutell & Tanis

[57] ABSTRACT

An evaporated fuel controller having a high load control valve in line with a release path communicating a canister to an air intake path, a low load control valve which is opened or closed in association with the high load control valve and located in line with the release path downstream from the high load control valve. One end of the release path is communicated to the canister and the other end communicated through branches to the air intake path downstream and upstream of the throttle valve, respectively. The high load control valve is provided in the release path communicating the canister to a branch point, and the low load control valve is provided in the branch of the release path communicating the branch point to the air intake path upstream of the throttle valve.

7 Claims, 2 Drawing Sheets

EVAPORATED FUEL CONTROLLER

FIELD OF THE INVENTION

This invention relates to an evaporated fuel controller, and more particularly to an evaporated fuel controller which releases an appropriate quantity of evaporated fuel in a range from a low load to a high load state in a combustion engine, which accurately detects evaporated fuel leakage from a component of an evaporating fuel controller, and which prevents degradation of an air/fuel ratio caused by releasing a large quantity of evaporated fuel in a low load state.

BACKGROUND OF THE INVENTION

In a combustion engine associated with a vehicle or other equipment, if evaporated fuel in the fuel tank leaks into the atmosphere, it becomes one of the causes for air pollution because a large quantity of hydrocarbons (HC) is contained in the evaporated fuel, and it also results in fuel loss. As a means for solving the problems described above, an evaporated fuel controller is used wherein evaporated fuel is absorbed by and stored in a canister with an absorbent such as activated carbon packed therein. The evaporated fuel absorbed by and stored in the canister is then released for combustion in an engine.

An evaporated fuel controller as described above is disclosed in Japanese Patent Laid Open Publication No. 268861/1986. The controller disclosed in this publication is used in a multicylinder combustion engine in which each cylinder has a suction pipe with a throttle valve provided therein. The suction pipes are communicated to each other by a communicating tube downstream from each throttle valve. A plurality of inlet ports each having a different passage area are provided in the aforesaid communicating tube to switch and communicate a purge port to the plurality of inlet ports by a switching valve according to the load of the combustion engine.

A conventional type of evaporated fuel controller is shown in FIG. 2 wherein 202 indicates a combustion engine, 204 indicates an air intake path, 206 indicates a throttle valve, 208 indicates an exhaust path, and 210 indicates a fuel tank. An evaporated fuel controller 212 in this combustion engine communicates the fuel tank 210 with a canister 214 by an intake path 216. The canister 214 is communicated to the air intake path 204 by a release path 218. The release path 218 comprises a main path section 220, a first branch path section 222, and a second branch path section 224. The main path section 220 extends from the canister 214 to a branch point 226. The first branch path section 222 extends from the branch point 226 to a first port 228 provided in the air intake path 204 downstream of the throttle valve 206. The second branch path section 224 extends from the branch point 226 to a second port 230 provided in the air intake path 204 downstream of the first port 228.

As described above, the release path 218 is communicated at one end thereof with the canister 214 and at the other end to the first port 228 and the second port 230.

In line with the first branch path section 222 is a high load control valve 232 which is opened or closed by a controlling section (not shown) so that evaporated fuel absorbed by and stored in the canister 214 is desorbed and released to the combustion engine for combustion under a high load. In line with the second branch path section 224 is a low load control valve 234 which is opened or closed by the controlling section mentioned above so that fuel absorbed by and stored in the canister 214 is desorbed and released to the combustion engine 202 for combustion under a low load.

In the evaporated fuel controller having the construction described above, however, the high load control valve 232 and the low load control valve 234 are opened or closed independently, and the evaporated fuel can not be released in an appropriate quantity in a range from a low load state to a high load state of the combustion engine 202, which may detrimentally cause fluctuations in the air/fuel ratio.

Also, sometimes a leakage diagnosis (i.e. a diagnosis on leakage of evaporated fuel from inside the device into the atmosphere) is required to be performed on an evaporated fuel controller. In the leakage diagnosis as described above, sometimes leakage of fuel from a component causes a problem. If a large quantity of evaporated fuel leaks from any component, it may cause an erroneous determination in the leakage diagnosis. In the evaporated fuel controller shown in FIG. 2, the high load control valve 232 and the low load control valve 234 are provided in parallel in the release path 218, so that a leakage rate specific to the control valve is doubled, and for this reason a quantity of evaporated fuel leaked from the high load control valve 232 and the low load control valve 234 each having the defect as described above doubles, which makes a precise determination of leakage difficult.

It should be noted that in some evaporated fuel controllers only a high load control valve is provided in the release path. In this type of evaporated fuel controller, inasmuch as a low load control valve is not provided therein, a precise flow rate of evaporated fuel released in a low load state such as in idling can not be insured, so that release of evaporated fuel is not carried out in a low load state in this type of evaporated fuel controller.

In order to solve the problems as described above, the evaporated fuel controller according to the present invention is characterized by a release path, one end of which is communicated to a canister for absorbing and storing evaporated fuel, and the other end of which branches into two paths at a branch point. A first branch path is communicated to an air intake path downstream from a throttle valve of a combustion engine, and a second branch path is communicated to the air intake path upstream from the aforesaid throttle valve. A high load control valve which is opened or closed in a range from a low load state to a high load state of the aforesaid combustion engine is provided in line with the release path communicating the aforesaid canister to the branch point. A low load control valve which is opened or closed in a low load state of the aforesaid combustion engine in association with the aforesaid high load control valve is provided in line with the second branch path and communicates the aforesaid branch point to the air intake path upstream from the throttle valve.

In the configuration according to the present invention, the high load control valve and the low load control valve can correlatively be opened or closed in a range from a low load state to a high load state of the combustion engine.

Also, a diagnosis can be executed more precisely by taking into account leakage from only one of the load control valves (as compared to a conventional type of system in which a high load control valve and a low load control valve are provided in parallel).

Furthermore, evaporated fuel can be diluted by mixing air introduced by the low load control valve from an air intake path upstream from the throttle valve with evaporated fuel released in a low load state of a combustion engine by the high load control valve.

DETAILED DESCRIPTION

Figure 1:
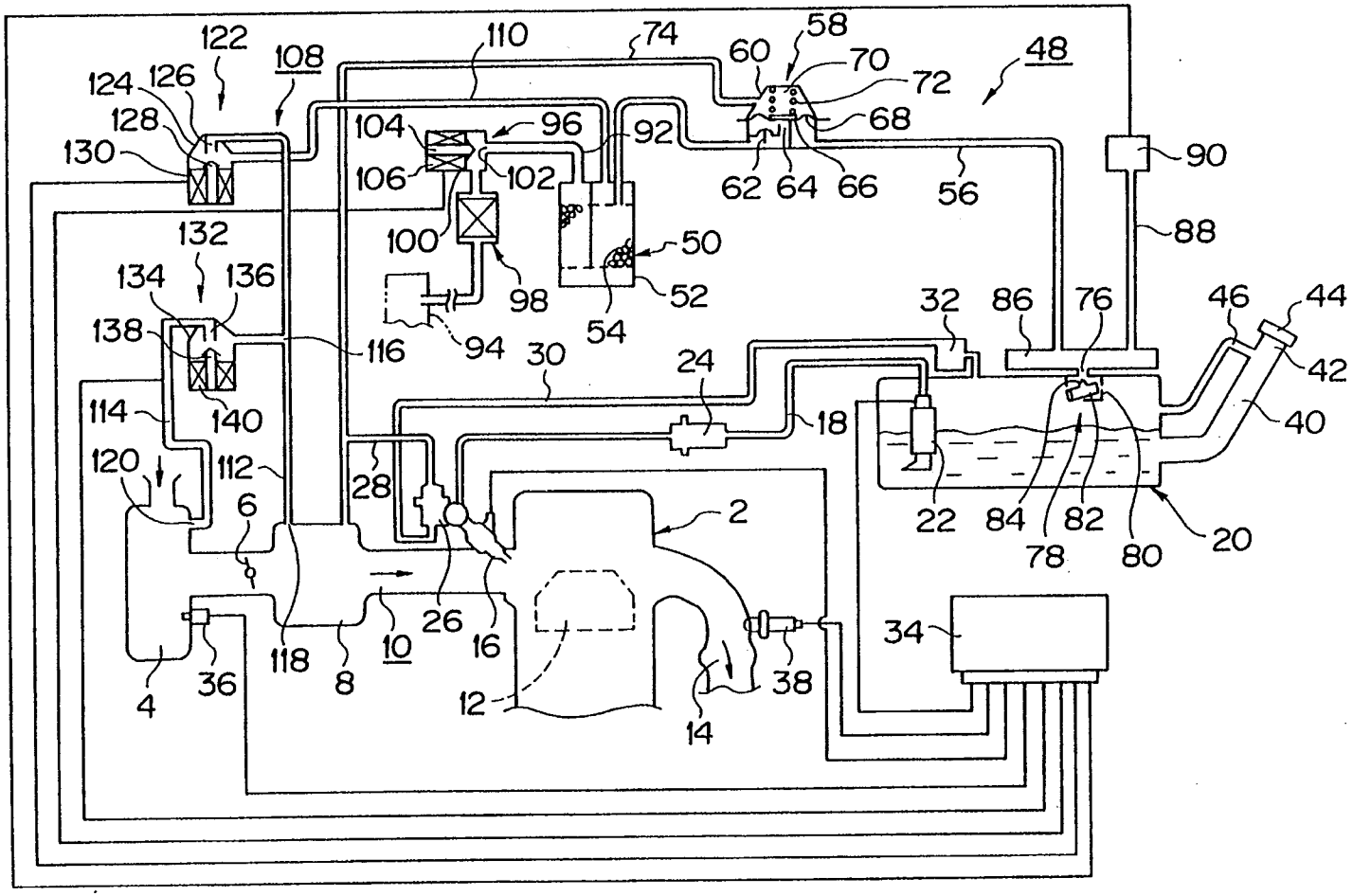
FIG. 1 illustrates a general configuration of an evaporated fuel controller according to an embodiment of the present invention.
Figure 2:
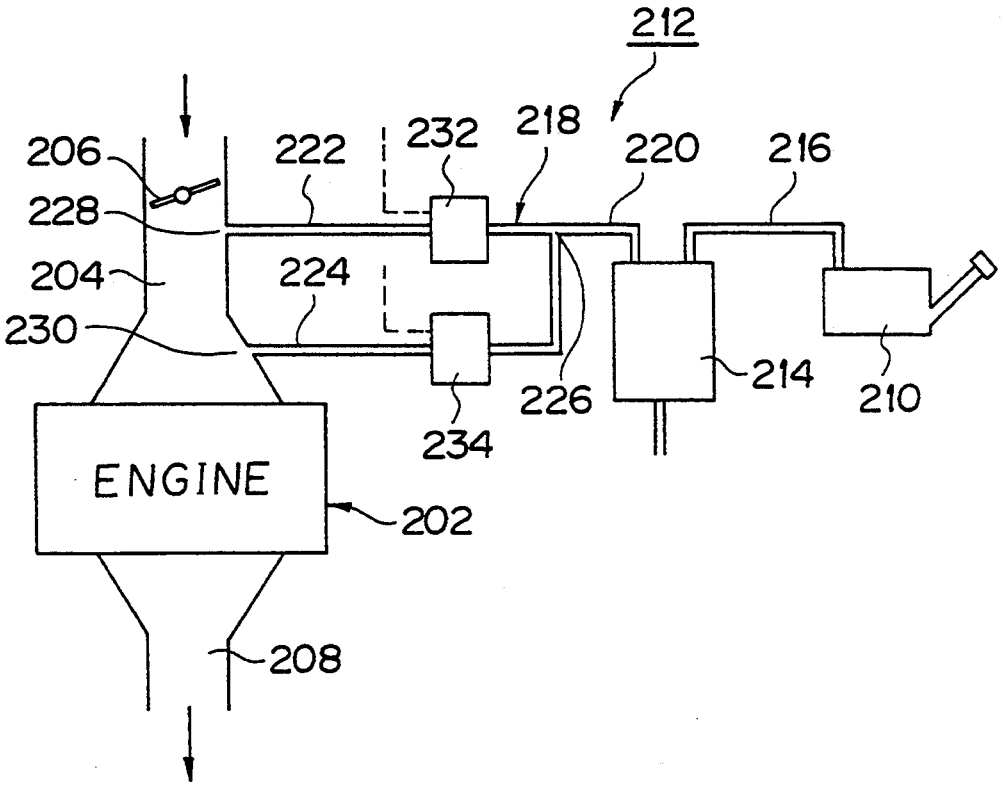
FIG. 2 PRIOR ART
FIG. 2 illustrates a general configuration of a conventional type of evaporated fuel controller.

FIG. 1 illustrates an embodiment of the present invention. In this figure, 2 indicates a combustion engine, 4 indicates an air cleaner, 6 indicates a throttle valve, 8 indicates a surge tank, 10 indicates an air intake path, 12 indicates a combustion chamber, 14 indicates an exhaust path, and 16 indicates a fuel injection valve. In the combustion engine 2, the fuel injection valve 16 facing the direction of the combustion chamber 12 is provided in the air intake path 10. The fuel injection valve 16 is communicated to a fuel pump 22 of the fuel tank 20 through the fuel supply path 18. A fuel filter 24 is provided in line with the fuel supply path 18. Pressure of the fuel fed to the fuel injection valve 16 is adjusted by a fuel pressure adjuster 26. The fuel pressure adjuster 26 adjusts the fuel pressure to a predetermined level by introducing a pressure in the air intake path 10 through an adjusting pressure introducing path 28 and returns the surplus fuel to the fuel tank 20 through a fuel return path 30. A return fuel tank 32 temporarily stores fuel returned from fuel pressure adjuster 26.

Fuel injection valve 16 is connected to a control section 34 which is a controller. An air sensor 36, an $O_2$ sensor 38, and other sensors (not shown) are also connected to control section 34. The control section 34 controls the air/fuel ratio to a desired level by controlling the operation of the fuel injection valve 16 according to signals received from sensors 36, 38.

Fuel tank 20 is provided with a supply path 40, one end of which is communicated to the fuel tank 20. Supply path 40 is disconnectably provided with a supply cap 44 at an end of a fuel supply port 42. Fuel tank 20 is also provided with a breather path 46 having one end thereof communicated to the fuel tank, and the other end communicated to the supply path 40 adjacent the supply port 42.

Engine 2 is provided with an evaporated fuel controller 48. Evaporated fuel controller 48 is provided with a canister 50. Canister 50 is provided with an absorbent 54 incorporated in a case 52. Canister 50 is communicated through an intake path 56 to the fuel tank 20.

Intake path 56 is provided with a relay valve 58 which is opened when the engine 2 is running. Relay valve 58 is provided with a reverse current stop valve 62 located in line with the intake path 56 in a housing 60 to allow distribution to the side of the fuel tank 20, a valve port 64 facing the side of fuel tank 20 in parallel with the stop valve 62, a valve body 66 supported by a diaphragm 68 to open or close the valve port 64, a spring 72 to press the aforesaid valve body 66 toward a pressure chamber 70 partitioned by diaphragm 68, and a pressure introducing path 74 communicating the pressure chamber 70 to the surge tank 8 downstream from the throttle valve 6.

Air intake path 56 is communicated with the fuel tank 20 via a separator 86. A passage 76 communicates the separator 86 with the fuel tank 20. A float valve 78 having a cage-like frame 80 supporting a moveable valve body 82 is disposed within the fuel tank 20 directly below the passage 76. Valve body 82 has an upwardly extending projection 84 which is adapted to close passage 76 when the fuel tank is completely filled with fuel. Otherwise, the valve body 82 is suspended within frame 80 thereby opening passage 76. A pressure sensor 90 is connected through a pressure path 88 to the separator 86. The pressure sensor 90 is connected to the aforesaid control section 34.

The canister 50 is provided with an atmospheric air path 92 having one end thereof communicated to the canister 50. The atmospheric air path 92 has an opening provided at the other end in a frame 94 of a vehicle (not shown) opened to the atmosphere. An atmospheric air control valve 96 and a filter 98 are provided in line with the atmospheric air path 92. The atmospheric air control valve 96 has a valve port 102 provided in line with the atmospheric air path 92 in a housing 100, a valve body 104 to open or close valve port 102, and a solenoid 106 to drive valve body 104 for opening and closing valve port 102. The atmospheric air control valve 96 is connected to the control section 34.

The canister 50 is communicated through a release path 108 to the air intake path 10. The release path comprises a main path section 110, a first branch path section 112, and a second branch path 114. The main path section 110 is a path from the canister 50 to a branch point 116. The first branch path section 112 is a path from the branch point 116 to a first port 118 provided in the air intake path 10 of the surge tank 8 downstream from the throttle valve 6. The second branch path section 114 is a path from the branch point 116 to a second port 120 provided in the air intake path 10 of the air cleaner 4 upstream from the throttle valve 6.

One end of the release path 108 is communicated to the canister 50, and the other end branching at the branch point 116 is connected to the first port of the air intake path 10 downstream from the throttle valve 6 and the second port 120 of the air intake path 10 upstream from the throttle valve 6.

In line with the main path section 110 constituting the aforesaid release path 108 is a high load control valve 122 which is opened or closed in a range from a low load state to a high load state of the combustion engine 2. The high load control valve 122 has a valve port 126 provided in line with the main path section 110 in a housing 124, a valve body 128 which opens or closes valve port 126, and a solenoid 130 to drive valve body 128 for opening and closing valve port 126.

In line with the second branch path 114 constituting the aforesaid release path 108 is a low load control valve 132 which is opened or closed in a low load state of the combustion engine 2 in association with the high load control valve 122. Low load control valve 132 has a valve port 136 provided in line with the second branch path section 114 in a housing 134, a valve body 138 to open or close valve port 136, and a solenoid 140 to drive valve body 138 for opening and closing valve port 136.

Constructed as described above, the release path 108 has the high load control valve 122 provided in the upstream side thereof and the low load control valve 132 provided in the downstream side thereof. The high load control valve 122 and the low load control valve 132 are both connected to the control section 34. The control section 34 controls opening or closing of the high load control valve 122 and the low load control valve 132 by means of duty control to supply the evaporated fuel, once absorbed by and stored in the canister 50, to the combustion chamber 12 for combustion according to the operating conditions of the combustion engine 2.

The following is a description of the operation of the evaporated fuel controller according to the present invention.

In the evaporated fuel controller 48, when the combustion engine 2 is running, the relay valve 58 is opened due to the negative pressure in the air intake path 10 which is communicated to the pressure chamber 70 via pressure introducing path 74. The control section 34 provides controls for opening or closing the atmospheric air control valve 96, the high load control valve 122, and the low load control valve 132 by means of duty control and according to the engine running condition. Because of this configuration, the evaporated fuel once absorbed by and stored in the canister 50 is desorbed and released according to the running conditions of the combustion engine and is supplied to the combustion engine for combustion.

Also in the evaporated fuel controller 48, when the combustion engine 2 is off, the relay valve 58 is closed, and the control section 34 provides controls for closing the atmospheric air valve 96, the high load control valve 122, and the low load control valve 132. With this operation, when pressure in the fuel tank rises above a specified level, the evaporated fuel generated in the fuel tank 20 pushes up the valve body 66 of the relay valve 58, flows into the air intake path 56, and is absorbed by and stored in the canister 50.

When the engine 2 is running in a low load state, evaporated fuel controller 48 provides controls for opening or closing the low load control valve 132 in association with the high load control valve 122. The evaporated fuel once absorbed by and stored in the canister 50 flows, when the high load control valve 122 is opened, from the main path section 110 of the release path 108 through the first branch path 112 to the first port 118 and is released to the air intake path 10.

Then when the low load control valve 132 is opened, the evaporated fuel flowing from the main path 110 through the first branch path 112 is mixed with air introduced from the second port 120 through the second branch path 114, and is thereby diluted and released into the air intake path 10. With this operation, a flow rate of released evaporated fuel can be controlled when the combustion engine 2 is in a low load state.

When the engine 2 is running in a high load state, the evaporated fuel controller 48 provides controls for closing the low load control valve 132 and opening or closing the high load control valve 122. When the high load control valve 122 is opened, the evaporated fuel once absorbed by and stored in the canister 50 flows from the main path 110 of the release path 108 through the first branch path section 112 to the first port and is released to the air intake path 10.

Then, because the low load control valve 132 is closed, the evaporated fuel flowing from the main path 110 through the first branch path section 112 is not mixed with the air introduced from the second branch path section 114 and is released into the air intake path 10. With this operation, when the combustion engine is running in a high load state, the flow rate of released evaporated fuel can be increased.

Thus, the evaporated fuel controller 48 has the high load control valve 122 which is opened or closed in a range from a low load state to a high load state of the combustion engine 2 in line with the main path 110 which is a release path communicating the canister 50 to the air intake path 10, and a low load control valve 132 which is opened or closed in a low load state of the combustion engine 2 in association with the high load control valve 122.

With this operation, the evaporated fuel controller 48 provides controls for opening or closing the high load control valve 122 and the low load control valve 132, respectively in a range from a low load state to a high load state of the combustion engine 2. For this reason, an appropriate quantity of evaporated fuel can be released in a range from a low load state to a high load state of the combustion engine 2 without causing any fluctuation of air/fuel ratio nor reducing the operability of the combustion engine.

In structural terms, the evaporated fuel controller 48 has the high load control valve 122 which is opened or closed in a range from a low load state to a high load state of the combustion engine 2 and provided in line with the main path section 110 which is a release path 108 communicating the canister 50 to the air intake path 10, and the low load control valve 132 which is opened or closed in a low load state of the combustion engine 2 in association with the high load control valve 122 and provided in line with the second branch path section 114 which is a release path 108 downstream from the high load control valve 122.

In contrast to a conventional type of release path wherein a high load control valve and a low load control valve are provided in parallel, diagnosis is carried out by only taking into account leakage from the high load control valve located in the upstream side of the release path while not taking into account the low load control valve located in the downstream side of the release path when diagnosing leakage from a system. For this reason, leakage of evaporated fuel from a component of the evaporated fuel controller 48 can be reduced, and a precise determination of leakage can be obtained.

Furthermore, the evaporated fuel controller 48 has the release path 108 with one end thereof communicated to the canister 50 and the other end branching at the branch point 116 and communicated to the air intake path 10 both downstream from the throttle valve 6 and upstream of the throttle valve 6.

Because of this configuration, in a low load state of the combustion engine 2, intake air introduced from the air inlet path 10 upstream of the throttle valve 6 by the low load control valve 132 can be mixed with the evaporated fuel released by the high load control valve 122 to dilute the evaporated fuel. For this reason, in a low load state of the combustion engine 2, even if a quantity of evaporated fuel is released to the engine, the air/fuel ratio is not condensed, and degradation of the air/fuel ratio can be prevented.

It should be noted that, even if a duty of the high load control valve 122 is set to a higher level, the negative pressure loaded by the low load control valve 132 to the release path 108 is weakened, so that uncontrollable increase of a quantity of evaporated fuel released from the canister 50 to the air intake path 10 can be prevented.

As described above, with the present invention, a high load control valve and a low load control valve can be opened or closed correlatively in a range from a low load state to a high load state of a combustion engine. For this reason, an appropriate quantity of evaporated fuel in proportion to a quantity of intake air can be released in a range from a low load state to a high load state of the combustion engine without fluctuation in the air/fuel ratio, which makes it possible to comply with strict environmental restrictions while simultaneously releasing a quantity of evaporated fuel to the engine.

Also, in contrast to a case where a high load control valve and a low load control valve are provided in parallel, as in a conventional type of release path, diagnosis can be carried out taking into account only leakage from the high load control valve located in the upstream side from the release path when diagnosing leakage from a system. For this reason, leakage of evaporated fuel from any component of the evaporated fuel controller can be reduced, and a precise leakage determination when diagnosing can be achieved.

Furthermore, in a low load state of a combustion engine intake air introduced from an intake path upstream from the throttle valve by the low load control valve can be mixed in the evaporated fuel released by the high load control valve to dilute the evaporated fuel. For this reason, even if a large quantity of evaporated fuel is released in a low load state of a combustion engine, the air/fuel ratio is not condensed and degradations to the air/fuel ratio can be prevented.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An evaporated fuel controller comprising:

a release path having an upstream end communicated to a canister for absorbing and storing evaporated fuel from a fuel tank therein and a downstream end communicated to an air intake path of a combustion engine;

a high load control valve means for opening and closing in a range from a low load state to a high load state of the combustion engine, the high load control valve means being disposed in line with the release path, and the high load control valve means regulating the quantity of evaporated fuel communicated from the canister to the air intake path; and a low load control valve means for opening and closing in a low load state of the combustion engine in association with the high load control valve means, the low load control valve means being disposed downstream from said high load control valve means, and the low load control valve means regulating a quantity of diluting air mixed with the evaporated fuel communicated to the air intake path.

2. The evaporated fuel controller as claimed in claim 1, wherein said release path further includes a branch point, a main path section upstream from said branch point, and first and second branch path sections downstream from said branch point, said first branch path communicated to said air intake path downstream from a throttle valve and said second branch path communicated to said air intake path upstream from said throttle valve, said high load control valve means disposed along said main path section, and said low load control valve means disposed along said second branch path section.

3. An evaporated fuel controller for an internal combustion engine comprising:

a release path having an upstream end communicated to a canister for absorbing and storing evaporated fuel therein and a downstream end branching at a branch point and communicated through a first branch path to an air intake path downstream from a throttle valve and through a second branch path to said air intake path upstream from said throttle valve;

a high load control valve means for opening and closing in a range from a low load state to a high load state of the combustion engine disposed in line with a main path section of said release path communicating said canister to said branch point; and a low load control valve means for opening and closing in a low load state of the combustion engine in association with said high load control valve and provided in said second branch path communicating said branch point to said air intake path upstream from said throttle valve.

4. The evaporated fuel controller claimed in claim 2, further comprising means for duty controlling said high and low load control valve means.

5. The evaporated fuel controller claimed in claim 3, further comprising means for duty controlling said high and low load control valve means.

6. An evaporated fuel controller for an internal combustion engine comprising:

a first release path for communicating evaporated fuel from an evaporative fuel canister to an air intake path of the engine downstream from a throttle valve, the canister absorbing and storing therein evaporated fuel from a fuel tank;

a second release path for communicating diluting air from said air intake path upstream from said throttle valve to an intermediate portion of said first release path;

a high load control valve means disposed in line with said first release path between said canister and said intermediate portion for varying the amount of evaporated fuel communicated from the canister to the air intake path;

a low load control valve means disposed in line with said second release path for varying the amount of diluting air communicated from said air intake path upstream of the throttle valve to the intermediate portion of said first release path, the air mixing with and diluting the evaporated fuel communicated to the air intake path; and means for controlling the high and low load valve means in accordance with a load state of the engine wherein an amount of evaporated fuel communicated to the air intake path varies in a range from a low load state to a high load state of the engine, an amount of diluting air communicated to the first release path varies in the low load state, and no diluting air is communicated to the first release path in the high load state.

7. The evaporated fuel controller claimed in claim 6, wherein said high and low load control valve means are duty controlled.

* * * * *